US005140222A

United States Patent [19]

Roznerski

[11] Patent Number: 5,140,222

[45] Date of Patent: Aug. 18, 1992

[54] HIGH-PRESSURE DISCHARGE LAMP

[75] Inventor: Alfred Roznerski, Windach, Fed. Rep. of Germany

[73] Assignee: Patent Treuhand Gesellschaft Fur Elektrische Gluhlampen m.b.H, Munich, Fed. Rep. of Germany

[21] Appl. No.: 732,083

[22] Filed: Jul. 18, 1991

[30] Foreign Application Priority Data

Sep. 28, 1990 [DE] Fed. Rep. of Germany ..... 4030820

[51] Int. Cl.[5] ..... H01J 17/18; H01J 61/36

[52] U.S. Cl. ..... 313/631; 313/623; 313/626; 313/334; 313/335

[58] Field of Search ..... 313/623, 335, 631, 334, 313/626

[56] References Cited

U.S. PATENT DOCUMENTS

| | | | |
|---|---|---|---|
| 3,636,401 | 1/1972 | Cortorillo et al. | 313/631 |
| 4,463,281 | 7/1984 | Triebel et al. | 313/623 |
| 4,559,472 | 12/1985 | Triebel et al. | 313/623 |
| 4,734,612 | 3/1988 | Sasaki et al. | 313/40 |

FOREIGN PATENT DOCUMENTS

| | | |
|---|---|---|
| 0264764 | 4/1988 | European Pat. Off. . |
| 1939204 | 5/1966 | Fed. Rep. of Germany . |
| 2324090 | 12/1973 | Fed. Rep. of Germany . |
| 2623099 | 12/1976 | Fed. Rep. of Germany . |
| 7835279 | 8/1979 | Fed. Rep. of Germany . |

*Primary Examiner*—Donald J. Yusko
*Assistant Examiner*—Ashok Patel
*Attorney, Agent, or Firm*—Frishauf, Holtz, Goodman & Woodward

[57] ABSTRACT

To reduce the quantity of a noble gas, typically xenon, and improve the shock and vibration resistance of the quartz glass bulb upon possible movement of electrode support shafts (4, 4') in transport or handling, a support element (6, 6') is engaged against a constriction between the bulb portion (1) and the neck portions (2, 2') of the discharge vessel structure. A spiral spring (8), preferably of tungsten, is engaged against one or more ceramic, perferably aluminum oxide disks, backed up against a melt seal, and pressing the respective disk or disks against the support element. The ceramic disks are loosely seated on the electrode shaft and located within the neck portions with clearance, so that, upon operation of the lamp, and expansion due to heating of the ceramic disks, the stability of the arc is improved and ignition is facilitated due to the lower fill pressure of the noble gas. The disks support the electrode shaft, decrease stress on the support element (6, 6') and permit better heat radiation to the necks, which can still be improved by coating the neck portions with a radiation emitting coating (11').

16 Claims, 1 Drawing Sheet

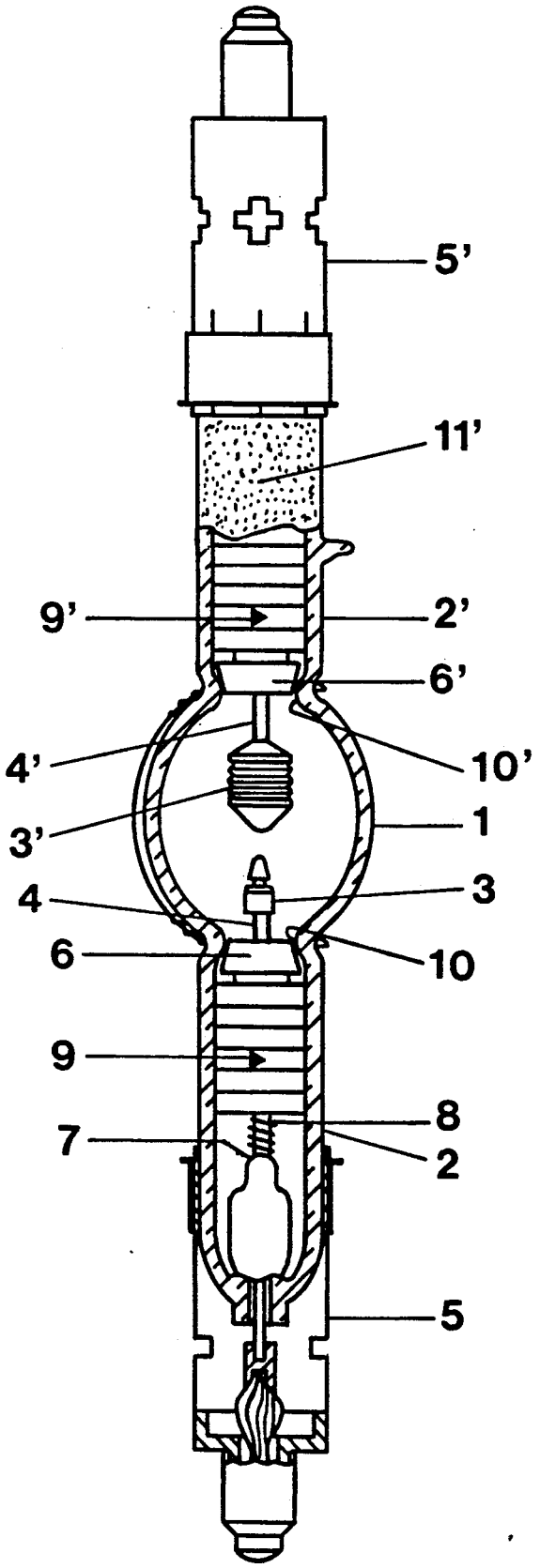
5'
11'
9'
2'
6'
4'
10'
3'
1
4
3
6
10
9
8
7
2
5

HIGH-PRESSURE DISCHARGE LAMP

Reference to related patents, the disclosures of which are hereby incorporated by reference, assigned to the assignee of the present application:

U.S. Pat. No. 4,463,281, Triebel and Bunke

U.S. Pat. No. 4,559,472, Triebel and Bunke.

Reference to related publications:

German Utility Model Publication GM 1 939 204

German Utility Model Publication GM 78 35 279.

FIELD OF THE INVENTION

The present invention relates to a high-pressure discharge lamp, and more particularly to a high-pressure discharge lamp having an electrode shaft which extends into a neck portion of the discharge vessel, and is resiliently retained therein to permit compensation for thermal expansion under operation of the lamp.

BACKGROUND

High-pressure discharge lamps having a fill which includes a noble gas, for example xenon, have relatively high operating currents. Even lamps of medium power, for example several hundred watts, require relatively heavy electrodes, made of high melting material, typically tungsten. These electrodes are heavy. They are usually retained on rods or shafts which form current supplies to the electrodes, which have a diameter of several millimeters. These electrode shafts, also of tungsten, are melt-sealed through neck portions joined to the actual discharge vessel. Usually, the assembly is manual, hence expensive and complex. To match the thermal coefficient of expansion of tungsten to the much smaller coefficient of quartz glass, transition glasses of intermediate thermal coefficients of expansion are used between the tungsten and the quartz glass, to permit a gas-tight/"graded seal" melt connection of the passage of the electrode shafts through the wall of the neck portion of the discharge vessel.

The melts forming the through-connections are mechanically sensitive. No forces must be transferred thereto from the electrode rods, since cracks or fissures may result, which, then, leads to the leakage of the lamp, rendering it useless.

Throughout the development of these lamps, many proposals were made to improve the gas-tight seal of the tungsten electrode shaft or electrode rod through the quartz glass vessel. German Utility Model Publ. GM 1 939 204, filed in 1964, describes a noble-gas high-pressure discharge lamp in which, starting at the transition from the actual discharge bulb to the neck until close to the melt seal are constricted to form a portion of reduced diameter of capillary form. The constriction is obtained by deformation, for example by using detonating gas, such as an oxyhydrogen blow system, for heating the constriction to a temperature of about 2000° C., thus softening the neck portion and permitting deformation. Providing a vacuum within the bulb structure facilitates engagement of the quartz glass on the electrode rods. Upon cooling to room temperature, a ring gap will result, having a spacing of a few tenths of a millimeter between the electrode rod and the supporting glass capillary. The capillary ensures reliable support of the electrode rods under the operating conditions of the lamp and provide for transfer of forces which may occur upon handling or transport, and which may arise due to vibration of the heavy electrodes. Forces on the melt seal itself are effectively prevented.

German Utility Model Publication GM 78 35 279, filed in 1978, illustrates a somewhat similar lamp having a support capillary structure of reduced length, and positioned in the bulb neck close to the bulbous portion. Reducing the length of the capillary improved the mechanical stability of the lamp, since shortening the capillary reduced the danger of breakage thereof. It further facilitated evacuation of the lamp, since the pumping resistance was reduced due to the shorter ring gap. This lamp was also substantially cheaper to make since a portion of the expensive manually made deformation work on the lead-through seal, which required highly skilled workers, was no longer needed.

U.S. Pat. No. 4,463,281, having a first filing (priority) date of Aug. 6, 1980, describes a high-pressure discharge lamp and a method of its manufacture, in which each one of the neck portions is formed with only a slight constriction in the vicinity of the transition between the neck portion and the bulbous portion of the discharge vessel. A support element is loosely threaded on the electrode shaft and engages the constriction. This support element is in the shape of a circular cylindrical roller of quartz glass, having a length of only a few millimeters. The support element is resiliently pressed against the constriction by a tungsten spring, threaded to surround the electrode rod and engaged against the melt seal. The electrode rod is thus supported resiliently and the reduced capillary, previously described, can be used to best advantage.

The slight constriction of the vessel neck reduces practically all danger of breakage in that region. The pumping path along the support element is reduced to only a few millimeters, and the previously expensive and complex deformation work is reduced to a minimum, merely to forming a slight constriction in the transition region between the discharge bulb and the neck portion of the overall discharge vessel.

The space which must be filled with noble gas has a relatively high volume, since it includes the neck portion beyond the bulb itself. This noble gas remains relatively cool in the neck portions, since it is not directly heated by the discharge process. Convection results, which lowers the overall temperature, and thus the operating pressure of the noble gas within the discharge bulb itself.

To obtain operating characteristics of lamps with capillaries which have not been foreshortened, it was necessary in the constructions so far described to increase the cold fill pressure of the noble gas, which then raises the necessary firing or ignition voltage required for firing or igniting the lamp to an undesired level. Additionally, costs arise because of the larger quantity of noble gas than absolutely necessary for operating of the lamp. The noble gas, typically xenon, is expensive.

It has been found that under some extreme and worst-case conditions, forces can be transmitted between the support element and the interior of the constriction, particularly during transport or careless handling. Under such conditions, friction, rubbing, and damage to the surface of the quartz glass may occur, undesirably affecting operation of the lamp. Resonance effects also may occur, particularly during transport.

In operation of the lamp, possible gas convection flow may lead to decrease of the stability of the discharge arc.

U.S. Pat. No. 4,559,472, having a first filing (priority) date of 1982, is a further step in the development of this type of lamp, and describes an electrode support system which eliminates the disadvantage of a relatively large volume which must be filled with noble gas within the portion of the discharge vessel neck, remote from the actual discharge space or bulbous discharge portion. An elongated circular cylindrical element, for example of quartz glass, is used which is loosely fitted on the electrode rod or shaft and fills the entire bulb neck between the melt seal and the actual discharge space or bulb itself. A spiral spring of tungsten loosely fitted on the electrode rod between the electrode and the quartz glass element appropriately positions this quartz glass element.

It has been found in actual use that it was difficult to properly match manufacturing tolerances and spring force to reliably position the relatively heavy quartz glass support element. Weakened springs and tolerance related variations resulted, from time to time, in damage to the melt seal by the heavy quartz element, movable along the electrode rod in axial direction.

THE INVENTION

It is an object to further improve such a lamp, which has been in development for decades, and to provide a lamp structure in which the space to be filled with the noble gas is as small as possible, while reliably supporting elongated and potentially heavy electrode shafts.

Briefly, at least one, and preferably a plurality, for example five or more, spacing disks are threaded on the electrode shaft, loosely surrounding the electrode shaft, and engaged by a spring to press the spacing disks against each other, and again a constriction, the spring itself being backed up or supported by the melt seal.

In accordance with a preferred feature of the invention, the spacing disks are made of a ceramic, for example $Al_2O_3$, and having a diameter which is just slightly less than the inner diameter of the neck portion. A support element, preferably of quartz glass, engages the constriction, and is located between the adjoining one of the spacing disks and the constriction.

The present invention, thus, further improves the reliable and proven arrangement to support the electrode rods, as exemplified, for example, by the structure of the referenced Triebel and Bunke U.S. Pat. No. 4,463,281, by providing one or preferably a plurality of circular cylindrical disks, preferably of ceramic, with a slightly smaller diameter than the inner diameter of the neck and then supporting this stack of ceramic disks with the tungsten spring. This arrangement requires only little deformation work on the discharge vessel bulb neck to make the constriction to properly position the support element, and very easily and simply permits exact matching of longitudinal tolerances and forces which arise due to compression of the spiral tungsten spring, so that a proper match of length of the stack of disks and spring force can be readily obtained. As a result, a secure, yet resilient seat of the support element and of the disk or disks on the electrode rod can be easily obtained.

The central bore of the disks through which the electrode rod or shaft passes is slightly larger then the diameter of the electrode shaft. Thus, some radial shift or offset of the disk with respect to the central axis of the electrode rod, up to touching of the inner wall of the neck by one of the disks, at one side, is possible. Thus, the disks take over a portion of the support function since, by friction against each other or, respectively, with the support element, they contribute to dampen any vibrations of the electrode rod, and thus advantageously lighten stresses on the support element and the constriction. It has been found that in the construction in accordance with the present invention, no wear and tear due to transport of the lamp results.

The plurality of disks have, further, other and unpredictable features. They permit heat transfer from the electrode rod to the wall of the neck portion of the quartz glass vessel and thus provide for cooling of the electrode rod. The temperatures on the electrode rod are markedly decreased with the disks placed thereon. This permits thermal protection of the melt seal of the electrode rod in the region of the base of the lamp, and thus increases the operating reliability of the lamp. Further improvement in heat dissipation of the additionally heated lamp neck can be obtained by further enhancing radiation from the outer surface of the lamp neck at the transition to the bulb and up to the region beneath the base sleeve, by coating that region with a layer of high radiation emission capability within the infrared and/or visible wave length range.

The disks have another advantage, namely that the thermal coefficient of expansion of the preferably used aluminum oxide ceramic, which is $7.5\times10^{-6}$/K, is substantially higher, namely by one order of magnitude, than that of quartz glass, the coefficient of expansion of which is $0.56\times10^{-6}$/K. In operation, the circular gap between the disks and the neck of the quartz glass shrinks substantially and is substantially less than at room temperature. Thus, convection currents within the overall discharge vessel, which might interfere with stability of the arc, are essentially inhibited. When manufacturing the lamp, however, the larger gap between the disks and the interior of the neck facilitates evacuating the discharge vessel.

DRAWINGS:

The single FIGURE is a front view, partly in section, illustrating a lamp in accordance with the present invention.

DETAILED DESCRIPTION

A quartz glass vessel has a discharge portion or discharge bulb 1 and two extending necks 2, 2'. The entire structure, discharge portion 1 and necks 2, 2', is made of quartz glass. Two electrodes 3, 3' are located coaxially, opposite each other, within the bulbous portion 1, and also define a central lamp axis. The electrodes 3, 3' are secured to electrode shafts or electrode rods 4, 4'. The electrode shafts 4, 4' are melt-sealed at the ends of the necks 2, 2' and connected electrically conductive to base terminals 5, 5'. The bases 5, 5' are cemented on neck portions of the lamp, and the electrical connection to the terminals is by stranded cables or wires, electrically secured to the electrode shafts 4, 4'.

A support element 6, 6', of quartz glass, is loosely fitted on or threaded on the electrode shafts 4, 4'. A compressed spiral spring 8 of tungsten is also threaded on the respective electrode 4, 4', engaged against the melt seal 7 at each end of the lamp. These melt seals 7 are well known and are shown only schematically.

In accordance with the present invention, a plurality of disks 9, 9' of aluminum oxide ceramic are interposed between the support element 6 and the spiral spring 8, so that the support element 6 is resiliently engaged against a constriction 10 formed in the transition zone between the bulb portion 1 and the neck portion 2. The upper electrode support arrangement is identical, and the same reference numerals have been used, with prime notation.

The support elements 6, 6' preferably are essentially frusto-conical elements, to provide for self-centering in the constriction 10, 10'.

The lamp illustrated is a 2 kW rated lamp, and the discharge vessel is filled with xenon at a pressure of about 8 bar.

For a lamp of this type, a suitable inner diameter of the necks 2, 2' is 19.0+0.4 mm, the outer diameter of the disks is 18.8–0.05 mm. The thickness of the disks is about 5.0±0.1 mm.

The electrode shafts or rods 4, 4' have a diameter of 4.0±0.02 mm. They are passed through a circular central opening in the disks having a dimension of 4.3+0.05 mm.

To provide for improved heat radiation, a high temperature resistant black layer 11', having a higher heat radiation emissivity than the uncoated quartz glass surface, for example a layer of lacquer or varnish with $Fe_2O_3$ pigmentation extends from the outer end of the necks 2, 2' to the transition to the bulbous portion. Consequently this high temperature resistant black layer 11' leads to a drop in temperature to 220° C. from a temperature of 250° for the coated necks, due to improved heat radiation and hence cooling, when operating the lamp at rated power in horizontal burning position.

Various changes and modifications may be made within the scope of the inventive concept.

I claim:

1. A high pressure discharge lamp having a discharge vessel structure including a quartz glass bulb (1) defining a lamp axis;

two neck portions (2, 2') extending from said bulb in alignment with said axis, and forming a transition region including a constriction in the region of a junction between the bulb and the respective neck;

two electrodes (3, 3') located within said bulb;

two electrode support shafts (4, 4'), one each supporting an electrode, and extending outwardly of the respective necks;

a melt seal (7) for each of said shafts, gas-tightly sealing the respective electrode shaft (4, 4') to a respective neck portion (2, 2'), said melt seals being located on the respective neck portion at the position remote from the bulb;

a support element (6, 6') loosely surrounding each of said shafts, located in said transition region between the bulb (1) and the respective portion (2, 2') and engaging the wall of the discharge vessel structure in the region of the constriction;

a fill, including at least a noble gas, within said discharge vessel structure, spring means (8) loosely surrounding the respective electrode shafts (4, 4') positioned adjacent to, and supported on the respective melt seals (7); and comprising a plurality of spacing disks (9, 9'), each disk defining a top and a bottom surface, said plurality of spacing disks forming a stack of disks loosely surrounding the respective electrode shafts, with radial clearance, and stacked on said electrode shafts and, at a temperature when the lamp is extinguished, having radial clearance from the interior wall of the respective neck portion, said plurality of spacing disks being positioned between the support element (6, 6') and the spring means (8), said spring means engaging an adjacent surface of one of the said disks and resiliently pressing facing surfaces of said disks in said stack of elements together.

2. The lamp of claim 1, wherein said plurality of spacing disks (9, 9') in the respective neck portion (2, 2') comprise ceramic material.

3. The lamp of claim 1, wherein said plurality of disks (9, 9') in each neck portion (2, 2') comprises aluminum oxide ceramic material.

4. The lamp of claim 1, wherein said plurality of disks (9, 9') in the respective neck portion (2, 2') has a thickness of between 1 to 5 mm, and a diameter which is less than the inner diameter of the neck portion (2, 2') by between 0.2 to 0.8 mm.

5. The lamp of claim 1, wherein said plurality of spacing disks (9, 9') are located within each neck portion;

wherein each of said plurality of disks (9, 9') comprises ceramic material having a thickness of between 1 to 5 mm, and a diameter which is less than the inner diameter of the respective neck portion (2, 2') by between 0.2 to 0.8 mm.

6. The lamp of claim 5, wherein said disks (9, 9') comprise aluminum oxide ceramic.

7. The lamp of claim 1, wherein said support element (6, 6') is self-centering within said constriction.

8. The lamp of claim 1, wherein said support element (6, 6') is of frusto-conical or part-spherical shape.

9. The lamp of claim 1, further including a high temperature resistant coating (11') applied to the outside of said neck portion (2, 2'), said coating having a high heat emission in at least the infrared spectral region.

10. The lamp of claim 1, further including a high temperature resistant coating (11') applied to the outside of said neck portion (2, 2'), said coating having a high heat emission in at least the visible spectral region.

11. The lamp of claim 9, wherein said high temperature resistant coating comprises a high temperature resistant black lacquer or varnish.

12. The lamp of claim 10, wherein said high temperature resistant coating comprises a high temperature resistant black lacquer or varnish.

13. The lamp of claim 1, wherein said plurality of spacing disks (9, 9') in the respective neck portion (2, 2') comprises ceramic material, optionally an aluminum ceramic;

and further including a high temperature resistant coating (11'), optionally a high temperature resistant lacquer or varnish, having a high heat emission within at least one of: infrared range, and visible spectral range.

14. The lamp of claim 1, wherein said noble gas of the fill comprises xenon.

15. The lamp of claim 13, wherein said noble gas of the fill comprises xenon.

16. The lamp of claim 1, wherein said plurality of disks forming the stack comprises at least five disks.

* * * * *